US005696278A

United States Patent [19]

Segers

[11] Patent Number: 5,696,278

[45] Date of Patent: Dec. 9, 1997

[54] DEGUMMING OF CRUDE GLYCERIDE OILS NOT EXPOSED TO PRIOR ENZYMATIC ACTIVITY

[75] Inventor: Jacobus Cornelis Segers, Nieuwerkerk a/d IJssel, Netherlands

[73] Assignee: Unilever Patent Holdings B.V., Rotterdam, Netherlands

[21] Appl. No.: 532,846

[22] PCT Filed: Mar. 4, 1994

[86] PCT No.: PCT/EP94/00639

§ 371 Date: Dec. 13, 1995

§ 102(e) Date: Dec. 13, 1995

[87] PCT Pub. No.: WO94/21762

PCT Pub. Date: Sep. 29, 1994

[30] Foreign Application Priority Data

Mar. 17, 1993 [EP] European Pat. Off. ..... 93200774

[51] Int. Cl.[6] ..... C11B 3/00

[52] U.S. Cl. ..... 554/176; 554/179

[58] Field of Search ..... 554/176, 179

[56] References Cited

U.S. PATENT DOCUMENTS 5,239,096 8/1993 Rohdenburg et al. ..... 554/176

OTHER PUBLICATIONS

Ohlson, J.S.R., JAOCS, vol. 53, "Processing Effects on oil Quality", pp. 299–301, 1976.

Kock, M., JAOCS, vol. 60, No. 2, "Oilseed pretreatment in connection with physical refining", pp. 198–202, 1983.

*Primary Examiner*—Jose G. Dees
*Assistant Examiner*—Deborah D. Carr
*Attorney, Agent, or Firm*—Cushman Darby & Cushman IP Group Pillsbury Madison & Sutro LLP

[57] ABSTRACT

The present invention relates to a process for the preparation of degummed glyceride oils, which comprises applying an acid degumming treatment to a crude glyceride oil which has not substantially been exposed to enzymatic activity. Preferably such crude glyceride oil has been obtained by heating and pressing glyceride oil containing vegetable material, optionally preceded by a cold pressing step, where the heating comprises an exposure of the vegetable material to a temperature of 30°–80° C. for 0.1–20 minutes, preferably for 0.1–15 minutes, more preferably 0.1–5 minutes, and then to a temperature of 80°–140° C., preferably 90°–110° C. for 1–60 minutes, preferably 15–20 minutes. Residual phosphorus levels of <7 ppm and even <2 ppm can be easily and consistently attained.

20 Claims, 1 Drawing Sheet

FLOWSHEET OF PRODUCTION PROCESS

FLOWSHEET OF PRODUCTION PROCESS

DEGUMMING OF CRUDE GLYCERIDE OILS NOT EXPOSED TO PRIOR ENZYMATIC ACTIVITY

This application is a 371 of PCT/EP94/00639 filed Mar. 4, 1994.

The present invention relates to a process for refining crude glyceride oil and in particular to a degumming process comprising the hydration and subsequent separation of phospholipids in glyceride oil.

STATE OF THE ART

Glyceride oils of, in particular, vegetable origin, such as soybean oil, rapeseed oil, sunflower oil, safflower oil and cottonseed oil, are a valuable raw material for the food industry. The crude oils are usually obtained from seeds and beans by pressing and consist mainly of triglyceride components.

The seeds being dried and comminuted (flaked) may be pressed without previous heating, which delivers cold-pressed oil. Alternatively the comminuted seed may be hot pressed either directly or after a preceding cold pressing step. Hot pressing is preceded by a conditioning treatment. This comprises heating the vegetable material to at least 80° C., and maintaining for about 30 minutes at the conditioning temperature. During warming up to the conditioning temperature the seed is exposed to temperature in the range of 30°–80° C. for about half an hour.

After conditioning the seed is pressed, e.g. within a revolving screw press.

Although seed pressing at an increased temperature affords a greater yield of oil, it has the disadvantage that the oil may considerably deteriorate by the action of enzymes native to the oil bearing material. The deteriorating effects comprises oil hydrolysis by lipase, glycosinolate decomposition by myrosinase, decomposition of phosphatidylcholine to phosphatidic acid by phospholipase D and oil oxidation by lipoxygenase. These effects are largely reduced when using a conditioning treatment during which those enzymes are inactivated. See e.g. EP0 187 877 and "Rapeseed, cultivation, composition, processing and utilization", Ed. L. A. Appelquist, 1972, chapter 9; "Manufacture of Rapeseed Oil and Meal", particularly pages 215–216.

Hardly attention has been given, however, to the effects of enzymatic activity before the inactivation of the enzymes. During the warming-up time, when the oil bearing material is exposed to temperatures in the range of 30°–80° C., the deteriorating enzymes are extremely active. Consequently the oil is subjected to considerable deterioration already before the conditioning temperature is reached. Although this effect was known, only recently commercial oil production has started according to a process with a reduced pre-conditioning deterioration. The improvement has been realised by a deliberately shorter exposure of the seed to temperatures of 30°–80° C.

The expelled oil contains a significant amount of undesired non-triglyceride constituents including phospholipids (gums), waxy substances, partial glycerides, free fatty acids, colour and flavour components and small amounts of metals such as iron, copper and magnesium. These impurities may have an undesirable effect on the stability of the oil, on the further processing of the oil and on the flavour and colour of products. It is therefore necessary to refine the crude glyceride oils, i.e. to remove the phospholipids and other impurities as much as possible.

In general degumming is the first step in glyceride oil refining. Without effective initial removal of the phospholipids many subsequent oil refining and modification processes do not give acceptable results.

In this context the term "degumming" relates to any treatment which results in the removal of phospholipids and associated components from the oil. The content of phospholipids is usually indicated as ppm phosphorus (P). The corresponding ppm amount of phospholipids can be found by multiplying the ppm P number with a factor 25.

A review of prior-art degumming processes is contained in e.g. the paper of J. C. Segers and R. L. K. M. van der Sande, entitled "Degumming—Theory and Practice", published in Proceedings of the AOCS World Conference on Edible Oils and fats, 2–6 Oct. 1989, Maastright, the Netherlands, or in Bailey's Industrial Oil and Fat Products, 4th Ed., Vol. 2, Chapter 4 or in The Lipid Handbook, 1986, Chapter 5.

Degumming processes generally start with water-degumming, which comprises the addition of merely water to the crude glyceride oil in order to hydrate the major part of the phospholipids. The phospholipids become insoluble and are separated. The residual phosphorus content stems from so-called "non-hydratable" phospholipids. In general this residue amounts to 100–250 ppm P. Since such levels are still unacceptable, water-degumming is followed by a treatment with an aqueous solution of acid or alkali which causes the hydration and separation of the major part of the initially non-hydratable phospholipids.

At the end the water phase, which contains the precipitated hydrated phospholipids, is separated from the oil phase by, preferably, centrifuge separation.

A very common and effective process for degumming glyceride oil comprises the addition of an aqueous alkali solution. The amounts are such that at least a part of the free fatty acids is converted into soap, while the phospholipids precipitate. Both the soap and the phospholipids concentrate in the water phase and are separated as soap stock. Alkali refining may afford oils with <10 ppm P. A disadvantage of this method is that a subsequent water washing of the oil phase requires a second centrifuge-separation step. This is essential for effectivoly purifying the oil from soap residues. Further alkali refining is a chemical treatment of the oil. Because the refining is considered to be non-natural and causes much effluent in the form of soap stock it is becoming less accepted. Non-chemical refining methods, including acid degumming which is considered more natural, are presently preferred.

Non-alkaline degumming processes comprise the acid degumming processes. These are characterised in that no alkali is admixed with the oil or an amount of alkali which is not greater than the amount of alkali necessary for neutralising acid or acid anhydride added to the oil in a preceding step. No soap stock is formed.

U.S. Pat. No. 4,049,686 discloses an acid degumming process according to which crude, optionally water-degummed oil is treated subsequently with a concentrated acid such as citric acid and water. This causes hydration of the phospholipids which separate as sludge. When hydration takes place at temperatures of <40° C., this process is denoted as "Superdegumming". It affords generally an oil with a residual phospholipids content of 15–30 ppm P.

Another acid degumming process is described in EP 0 195 991. According to this process referred to as "Topdegumming" the water-degummed oil is first exposed to acid in the form of a very fine dispersion in oil. Then the acidified oil is admixed with an amount of aqueous alkali which is just sufficient to increase the pH of the acid-in-oil dispersion to above 2.5. This refining process is carried out at a temperature of at least 75° C. After the first centrifuge separation still 100 ppm P is present. For an effective removal of separated sludge at least two centrifuge-separations are necessary. Only then a final phospholipid level of 7 ppm may be attained.

EP 0 473 985 describes still another acid degumming process which is quite similar to the Superdegumming process. It specifically mentions the use of a flocculation promoting agent. The obtained oil contains <10 ppm P, but at least one extra washing step and centrifuge separation is needed.

As yet not single-separation acid degumming process for crude glyceride oil is known which consistently delivers oil with less than 7 ppm P.

STATEMENT OF THE INVENTION

It has now been found that the phosphorus content of acid degummed glyceride oils can be considerably further reduced when a crude glyceride oil is chosen which has not been exposed to substantial enzymatic activity.

Accordingly it is an object of the present invention to provide an acid degumming process with which reliably low levels of residual phosphorus can be attained. Depending on the type of acid degumming these may be less than 7 ppm P. Levels even less than 2 ppm P can be attained fairly consistently.

Accordingly the present invention relates to a process for the preparation of degummed glyceride oils, which comprises applying an acid degumming treatment to a crude glyceride oil which has not substantially been exposed to enzymatic activity.

Preferably such crude glyceride oil has been obtained by heating and pressing glyceride oil containing vegetable material, optionally preceded by a cold pressing step, where the heating comprises an exposure of the vegetable material to a temperature of 30°–80° C. for 0.1–20 minutes, preferably for 0.1–15 minutes, more preferably 0.1–5 minutes, and then to a temperature of 80°–140° C., preferably 90°–110° C., for 1–60 minutes, preferably 15–20 minutes.

DESCRIPTION OF THE FIGURE

The flow-sheet on FIG. 1 illustrates the various expelling processes: "A" is the route for cold pressing, "B" the route for hot pressing with a preceding cold pressing step "A" and the dashed line "C" is the straight hot pressing route without preceding cold pressing step. Both processes B and C contain a step of expelling previously heated vegetable material.

DETAILS OF THE INVENTION

Figure 1:
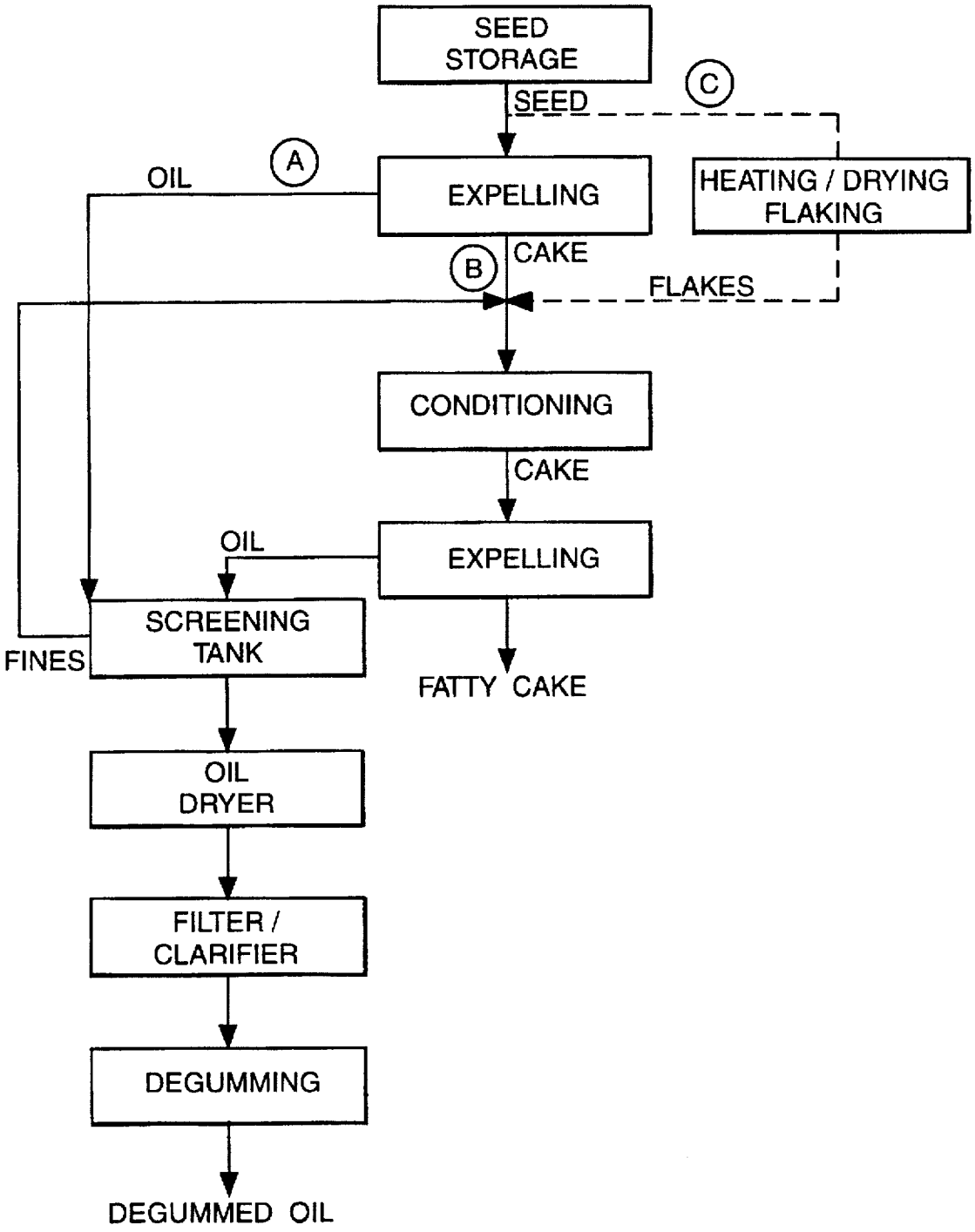

The oil-bearing plant material may be any oil crop which can be processed by pressing and it is preferably selected from the group comprising soybeans, sunflower seed, safflower, cottonseed, corn, ground nuts, cocoa beans and, more preferably, rapeseed.

The moisture content of the vegetable material preferably is 1–16 wt. % with respect to the non-oil and non-moisture part of the vegetable material. This is the part comprising all vegetable material of the seed, bean etc. except the oil and the water. This means that the moisture content of e.g. rapeseed preferable is 0.5–8 wt. % on seed. Higher moisture contents eventually will result in a crude oil which contains impurities of such a nature that a tougher degumming treatment is necessary.

In contrast to the prior art the present degumming process uses an oil which has not been exposed to substantial enzymatic activity. An exposure to substantial enzymatic activity is prevented by a conditioning treatment preceded by a quick heating of the vegetable material to the conditioning temperature. In practice quick heating means an exposure time to temperatures of 30°–80° C. which is 0.1–20 minutes, preferably 0.1–15 minutes and more preferably 0.1–5 minutes. This quick heating applies to all material to be conditioned, also to the cold pressed cake to be subjected to hot pressing. For inactivation of native enzymes the conditioning temperature should be 80°–140° C., preferably 90°–110° C. It has to be maintained for 1–60 minutes, preferably 15–20 minutes.

According to a particular embodiment the process is characterised in that within 0.1–15 minutes, preferably 0.5–5 minutes the oil containing vegetable material having a temperature of 0°–40° C. is heated to a temperature of 90°–130° C., preferably 100°–200° C. and maintained at that temperature for 1–60 minutes, preferably 15–20 minutes.

For ensuring quick heating no special equipment is necessary. It suffices to reduce the load of the conditioner cooker or to use a fluid bed heater for ensuring a quick heat transfer. Proper conditions may be easily found by some try-outs.

The oil is produced by hot pressing the conditioned vegetable material. Cold pressing, when used, is applied directly on the vegetable material without intentionally heating, while hot pressing is applied either on the pressed cake remaining after cold pressing or directly on the seeds, beans etc. after these have been subjected to a conditioning treatment as described hereafter.

The expelled oil is preferably dried very soon after its separation in the press. Within 1–60 minutes, preferably within 1–20 minutes and more preferably within 1–10 minutes after pressing the drying treatment should be completed. A short time, for example ten minutes may be allowed for passing a screening tank where the fines, the major part of non-soluble vegetable material is discarded. The aimed moisture level is 0.03–0.1 wt. %. Ay oil drying method can be used, e.g. heating the oil under reduced pressure. This quick reduction of the water content provides additional protection against deterioration by any residual enzymatic activity.

A part of the fines may have stayed in the expelled oil which has passed the screening tank and which therefore may show some residual enzymatic activity, particularly those originating from cold pressed oil. According to another preferred embodiment the oil is cleared from all or part of non-soluble vegetable material including fines, e.g. by a filter or centrifuge operation. Preferably the residue of non-soluble vegetable material should be reduced to 0.01–0.25 wt. % on oil.

The process for obtaining the crude glyceride oil to be used for the invention may include an initial cold pressing step. Such cold pressed oil has been found to be degummable only under conditions which are more drastic than the conditions of acid degumming, particularly superdegumming. Table Ia illustrates the effect of superdegumming on the cold pressed and the hot pressed oil obtained from the same seed batch.

TABLE Ia

| | Crude (ppm P) | Superdegummed (ppm P) |
|---|---|---|
| Hot pressed rapeseed oil | 156 | 8 |
| Cold pressed rapeseed oil | 19 | 18 |

In order to lower the phosphorus content of the cold pressed oil an extremely high amount of acid has to be used.

Additionally filter aid must be applied for effective sludge removal, which makes the disposal of the filter cake more difficult.

However, it has been found that with the use of a special embodiment of the present invention the degumming problem of cold pressed oil can be solved. That special embodiment comprises taking as the object of the acid degumming treatment the hot pressed oil obtained without substantial exposure to enzymatic activity but diluted with cold pressed oil, preferably in a ratio of 5:1 to 1:5, more preferably in a ratio of 1:3 to 1:1 (hot pressed oil: cold pressed oil). Table Ib illustrates that under normal superdegumming conditions a surprisingly low phosphorus content is attained, even while the cold pressed oil forms the larger part of the crude oil.

TABLE Ib

| | Crude (ppm P) | Superdegummed (ppm P) |
|---|---|---|
| Cold pressed rapeseed oil | 64 | 7.7 |
| 3 parts cold-pressed rapeseed oil admixed with 1 part hot-pressed rape-seed oil | 163 | 3.3 |

It should be noted that the present invention enables the degumming of glyceride oils, including cold pressed oils provided mixed with hot pressed oils, beyond the boundary of 5 ppm P. A glyceride oil which after degumming contains <5 ppm P is considered to belong to a quality class which permits to deodorize and to hydrogenate the oil without previous purification. Thus a seemingly slight decrease of the P level following the present invention allows a major simplification in overall processing.

The degumming process which is part of the invention is an acid degumming process. Any acid degumming process may be used. The invention requires no special adaptations or modifications apart from the choice of the crude oil. Acid degumming comprises commercially applied processes such as superdegumming and topdegumming as mentioned hereinbefore.

Common to acid degumming processes is that a glyceride oil is exposed to an aqueous solution of an edible acid, such as citric acid or phosphorus acid, or an acid anhydride of such edible acid, followed by contacting the oil with water. The acid or acid anhydride used by be any acid or corresponding acid anhydride which converts the phospholipids into hydratable phospholipids. The acid or acid anhydride should be non-toxic, miscible with water, and may be of both inorganic and organic origin. The amount of acid or acid anhydride used should be such, that substantially all phospholipids present are converted in the hydratable form. In general, suitable amounts of acid are in the range of 0.01–1 wt. %, preferably 0.01–5 wt. % of the glyceride oil. Citric acid is suitable added in an amount of 0.01–0.4 wt. % of the glyceride oil as a citric acid solution, preferably as a 50 wt. % by weight aqueous citric acid solution. Phosphoric acid is suitable used in an amount of 0.02–0.4 wt. %, preferably as a 35 wt. % aqueous phosphoric acid solution.

During the acid treatment generally the oil temperature is rather high. A suitable range is 60°–95° C., preferably 70°–90° C. Optionally an aqueous alkali solution may be added after the acid treatment presumably for better sludge separation. The amount should not surpass the amount necessary to neutralise the acid or acid anhydride previously added to the oil. Then the oil is hydrated by contacting the oil for 0.5–180 minutes with water, preferably 0.2–5 wt. % of water or with the alkali solution. The amount of water in the oil should be high enough for hydration of all phospholipids. The hydrated phospholipids will precipitate and are removed from the oil, preferably by centrifuge separation.

A most preferred embodiment of the above described acid degumming process is the so-called Superdegumming process. This process is characterised by the additional feature that the acidified oil during the subsequent water contact is kept at a temperature of 10–40° C., preferably 15°–25° C. Superdegumming is appreciated because it reduces the amount of residual phospholipids considerably, while only one centrifuge separation is needed, which of course enhances process economy and reliability.

The present invention when using Superdegumming enables the production of degummed oils with a residual phosphorous level which consistently (see Table III) has appeared to be less than 7 ppm and even much lower.

In conclusion, the present invention provides a simple single-separation degumming treatment, suited for obtaining glyceride oils with ultra low phosphorus contents of preferably 0.1–7 ppm, more preferably 0.1–5 ppm and still more preferably 0.1–2 ppm phosphorus levels.

Oils with a 0.1–7 ppm phosphorus level are very suitable for carrying out in good yields subsequent oil treatments, whether these treatments are of a physical nature such as bleaching and steam distillation or of a chemical nature such as interesterification and hydrogenation.

The process of the invention has also been unexpected impact on the residual levels of magnesium and iron. The lowest magnesium level for degummed oils being not bleached and not alkali refined mentioned in the prior art (EP 0 513 709) is 0.1 ppm. But when using the invention the extra-ordinary low level of 0.01–0.07 ppm is attained. Therefore the invention also comprises degummed glyceride oil being not bleached and not alkali refined which contains 0.01–0.07 ppm magnesium.

The content of residual iron in the oil produced according to the invented process is 0.001–0.04 ppm and may be even 0.001–0.01 ppm, which is considerably lower than the lowest level (0.1 ppm) attained with degumming processed presently in use. Therefore the invention also comprises degummed glyceride oil being not bleached and not alkali refined which contains 0.001–0.04 ppm, preferably 0.001–0.01 ppm iron. Iron is known for its negative effect on the oxidative stability of glyceride oil.

A consistently low level of impurities has further advantageous results: e.g. it affords a saving on the use of expensive bleaching earth in a subsequent bleaching step.

The invention is illustrated with the following examples:

EXAMPLE 1

Preparation of Dry Crude Rapeseed Oil

Rapeseed with a moisture content 7.5–8 wt. % was heated, from 15° to 30° C. in 5 minutes. The seed was dried and comminuted to flakes. Then the flakes were heated in 10 minutes to 100° C. and for 20 minutes conditioned at that temperature to destroy enzymatic activity.

The conditioned material was hot pressed at a temperature of about 100° C. The hot pressed oil was collected and the major part of the fines was removed from the oil in a screening tank. 15 minutes after pressing the oil was dried at 90° C. and 100 mbar to a moisture content of 0.04 wt. %. After filtration, where any solid vegetable material was retained in the filter cake, the oil was stored.

The phosphorus content was 359 ppm.

Removal of Phospholipids

The dry crude rapeseed oil, obtained according to the procedure in the previous section, was subjected to the following degumming process:

1. 1 kg of crude oil was heated up to 70° C. in a stainless steel reactor (300 rpm, Rushton turbine).
2. 0.1 wt. % of citric acid (dosed as a 50 wt. % aqueous solution) was added, followed by homogenization (10 min., 600 rpm Rushton turbine, at 70° C.
3. The oil was cooled down to 20° C. and 2.0 wt. % of demineralised water was added;
4. Homogenization (5 min., 600 rpm (Rushton turbine)
5. After 115 minutes staying, hydration of the phospholipids (20° C., 300 rpm, Rushton turbine) was completed and the gums were separated by centrifugation (10 min, 1100 rpm (=100 g))

the phosphorus content of the degummed oil was 2 ppm and the iron content 0.03 ppm.

EXAMPLE 2

Preparation of Dry Crude Rapeseed Oil

Rapeseed with a moisture content of 7.5–8 wt. % was subjected to a cold pressing treatment. The remaining pressed cake was heated within 10 minutes to 120° C. and for 15 minutes conditioned at that temperature to destroy enzymatic activity. Then the conditioned material was hot pressed at a temperature of about 100° C., leaving a pressed cake containing about 9 wt. % residual oil. The hot pressed oil was collected and the major part of the fines was removed from the oil in a screening tank. Within 15 minutes after pressing the oil was dried at 90° C. and 100 mbar to a moisture content of 0.04 wt. %. After filtration, where any solid vegetable material was retained in the filter cake, the oil was stored. The cold pressed oil was purified from fines and water in the same way.

The production was repeated with seed batches from consecutive months. Nine samples of different oil production runs were delivered.

The analytical results on phosphorus content are given in Table II.

Removal of Phospholipids

A mixture of 2 parts of cold pressed rapeseed oil and 1 part of hot pressed rapeseed oil, which oils have been obtained according to the procedure in the previous section, was degummed by the process of example 1 . The process was repeated for all nine samples of the different oil production runs.

The analytical results of the samples, given in Table III, show that the phosphorus content is always less than 2 ppm and the iron content never more than 0.01 ppm.

TABLE II

| | Phospholipids in crude oil | | |
|---|---|---|---|
| Sample* | Cold pressed ppm P | Hot pressed ppm P | 2:1 mix ppm P |
| 1 | 31 | 551 | 204 |
| 2 | 41 | 597 | 226 |
| 3 | 50 | 596 | 232 |
| 4 | 38 | 682 | 253 |
| 5 | 46 | 800 | 297 |
| 6 | 36 | 713 | 262 |
| 7 | 27 | 496 | 184 |
| 8 | 48 | 642 | 246 |
| 9 | 20 | 264 | 101 |

*Samples 1–9 are from subsequent monthly deliveries from the oil mill.

TABLE III

| | Residues in degummed oil | | | |
|---|---|---|---|---|
| | Phospholipids | | | |
| Sample* | ppm P crude C/H = 2:1 | ppm P degummed | Iron ppm | Magnesium ppm |
| 1 | 204 | <1 | <0.01 | 0.07 |
| 2 | 226 | <1 | <0.01 | <0.05 |
| 3 | 232 | <1 | <0.01 | 0.07 |
| 4 | 253 | <2 | 0.01 | <0.05 |
| 5 | 297 | <2 | 0.01 | <0.05 |
| 6 | 262 | <2 | 0.01 | <0.05 |
| 7 | 184 | <1 | 0.01 | <0.05 |
| 8 | 246 | <1 | 0.01 | 0.11 |
| 9 | 101 | 1.1 | <0.01 | <0.05 |

I claim:

1. In a process for the preparation of degummed glyceride oil by subjecting crude glyceride oil to an acid degumming treatment, the improvement which comprises using crude glyceride oil which has not substantially been exposed to enzymatic activity, said crude glyceride oil being obtained by heating and pressing glyceride oil containing vegetable material, optionally preceded by a cold pressing step, where the heating comprises an exposure of the vegetable material to a temperature of 30°–80° C. for 0.1–20 minutes and then to a conditioning temperature of 90°–140° C. for 1–60 minutes.

2. Process according to claim 1 wherein the glyceride oil containing vegetable matter is initially at a temperature of 0–40° C. and within 0.1–15 minutes is heated to a temperature of 90°–130° C., and maintained at that temperature for 1–60 minutes.

3. Process according to claim 1 wherein the moisture content of the oil containing vegetable material is 1–16 wt. %, with respect to the non-oil and non-moisture part of the vegetable material.

4. Process according to claim 1 wherein the oil after said conditioning is collected and is then dried within 1–60 minutes after separation from the vegetable material.

5. Process according to claim 4, wherein the collected oil is dried to a moisture content of 0.03–0.1. wt. %.

6. Process according to claim 1 wherein all or part of non-soluble vegetable material is removed from the collected oil, to a concentration of 0.01–0.25 wt. %.

7. Process according to claim 1 wherein the crude oil is subjected to the acid degumming treatment as a mixture of cold pressed oil and hot pressed oil, in a ratio of 5:1 to 1:5.

8. Process according to claim 1 wherein the acid degumming treatment comprises consecutively:

a. adding an aqueous solution of an edible acid or acid anhydride to the oil,
b. exposing the oil to the acid,
c. optionally, adding an aqueous alkali solution,
d. contacting the oil during 0.5–180 minutes with water or with the alkali solution,
e. removing the sludge separated from the oil.

9. Process according to claim 8, wherein the oil/water mixture of step d. is kept at a temperature of 10°–40° C.

10. Process according to claim 9 wherein alkali added, if any, is not greater than the amount of alkali necessary for neturalising the acid or acid anhydride previously added to the oil.

11. Process according to claim 10 wherein the sludge separated from the oil during the acid degumming treatment is effectively removed by not more than one centrifuge-separation.

12. Process according to claim 11 wherein a degummed oil is obtained with a phosphorus content of 0.1–7 ppm.

13. Process according to claim 12 wherein a degummed oil is obtained with a magnesium content of 0.01–0.07 ppm and an iron content of 0.001–0.04 ppm.

14. Degummed glyceride oil which is not bleached and not alkali refined, characterised in that it contains 0.01–0.07 ppm magnesium.

15. Degummed glyceride oil which is not bleached and not alkali refined, characterised in that it contains 0.001–0.04 ppm iron.

16. A process according to claim 1 wherein the heating is carried out for 0.1 to 5 minutes and the conditioning is carried out at 90°–110° C. for 15–20 minutes.

17. A process according to claim 4 wherein the collected oil is dried within 1–10 minutes.

18. A process according to claim 7 wherein the ratio of cold pressed oil and hot pressed oil is 3:1 to 1:1.

19. A process according to claim 12 wherein the phosphorous content of the degummed oil is 0.1–2 ppm.

20. Degummed glyceride oil according to claim 15 which contains 0.001–0.01 ppm iron.

* * * * *